US010024615B1

(12) United States Patent
Oh et al.

(10) Patent No.: US 10,024,615 B1
(45) Date of Patent: Jul. 17, 2018

(54) FIREARM LOCKING DEVICE

(71) Applicant: VARA CORPORATION, Clifton Park, NY (US)

(72) Inventors: Timothy Oh, La Habra, CA (US); Jorel Lalicki, Troy, NY (US)

(73) Assignee: VARA CORPORATION, Clifton Park, NY (US)

( * ) Notice: Subject to any disclaimer, the term of this patent is extended or adjusted under 35 U.S.C. 154(b) by 0 days.

(21) Appl. No.: 15/871,470

(22) Filed: Jan. 15, 2018

Related U.S. Application Data

(60) Provisional application No. 62/446,603, filed on Jan. 16, 2017.

(51) Int. Cl.

| | |
|---|---|
| ***F41C 33/02*** | (2006.01) |
| ***F41A 17/54*** | (2006.01) |
| ***G07C 9/00*** | (2006.01) |
| ***E05B 47/00*** | (2006.01) |

(52) U.S. Cl.
CPC ..... *F41A 17/54* (2013.01); *E05B 47/0001* (2013.01); *F41C 33/0263* (2013.01); *G07C 9/00158* (2013.01); *E05B 2047/0089* (2013.01)

(58) Field of Classification Search
CPC ..... F41A 17/46; F41C 33/0263
USPC ..... 42/70.07, 70.11, 70.01; 206/317; 224/243, 244
See application file for complete search history.

(56) References Cited

U.S. PATENT DOCUMENTS

| | | | | |
|---|---|---|---|---|
| 5,416,472 | A | 5/1995 | Torii, Jr. | |
| 5,487,234 | A | 1/1996 | Dragon | |
| 5,611,164 | A | 3/1997 | Rassias | |
| 6,301,815 | B1 | 10/2001 | Sliwa | |
| 6,320,975 | B1 * | 11/2001 | Vieweg | F41C 33/0227 224/193 |
| 6,339,892 | B1 | 1/2002 | Ramos | |
| 6,601,332 | B1 | 8/2003 | Riebling | |
| 6,641,009 | B2 * | 11/2003 | French | F41C 33/0209 224/193 |
| 6,732,891 | B2 * | 5/2004 | Locklear, III | F41C 33/0209 224/244 |
| 6,918,519 | B2 | 7/2005 | Vor Keller et al. | |
| 7,530,456 | B1 * | 5/2009 | Tsai | F41C 33/0236 206/317 |

(Continued)

FOREIGN PATENT DOCUMENTS

| | | | | |
|---|---|---|---|---|
| DE | 202014101006 U1 * | 4/2014 | ..... | F41C 33/0263 |

*Primary Examiner* — Reginald S Tillman, Jr.

(74) *Attorney, Agent, or Firm* — Heslin, Rothenberg, Farley & Mesiti, P.C.

(57) ABSTRACT

A locking device includes a housing and a locking mechanism mounted within the housing. A locking bolt is operatively connected to the locking mechanism such that the locking bolt is moveable from an unlocked position to a locked position. An insert is sized to be removably received within an insert aperture of the housing. The insert includes a locking bolt hole sized to receive the locking bolt. The insert also includes a trigger guard cavity, sized to receive a trigger guard of a firearm. The insert also includes an insert contoured surface shaped to conform to a frame surface of the firearm. When the insert is disposed within the insert aperture and the locking bolt is in the locked position, the locking bolt extends through the locking bolt hole and at least partially through the trigger guard, and the insert contoured surface engages the frame surface, to secure the firearm.

19 Claims, 8 Drawing Sheets

(56) References Cited

U.S. PATENT DOCUMENTS

| | | | | |
|---|---|---|---|---|
| 8,006,424 | B1 | 8/2011 | Ligard | |
| RE44,428 | E * | 8/2013 | Spielberger | F41C 33/0263 224/238 |
| 9,759,515 | B2 * | 9/2017 | Yeates | F41C 33/0227 |
| 2002/0157296 | A1 * | 10/2002 | Vivian | F41A 17/066 42/70.11 |
| 2008/0142556 | A1 * | 6/2008 | Fan | A45F 5/02 224/243 |
| 2009/0224014 | A1 * | 9/2009 | Kumuchian | F41C 33/0263 224/244 |
| 2010/0176165 | A1 * | 7/2010 | Lowe | F41C 33/0209 224/191 |
| 2010/0212372 | A1 | 8/2010 | Wolfe | |
| 2014/0291363 | A1 * | 10/2014 | Clifton, Jr. | F41C 33/0263 224/244 |
| 2016/0116253 | A1 * | 4/2016 | Moon | F41C 33/029 224/244 |
| 2018/0073836 | A1 * | 3/2018 | Romeo | F41C 33/0263 |

* cited by examiner

FIREARM LOCKING DEVICE

CROSS REFERENCE TO RELATED APPLICATION

This application claims priority to U.S. provisional application No. 62/446,603, filed on Jan. 16, 2017, the entire contents of which are hereby incorporated herein by reference.

TECHNICAL FIELD

The present invention relates to firearm locking devices. More specifically, the invention relates to firearm locking devices having a removable insert for securely engaging a portion of a frame of a firearm.

BACKGROUND

There are various methods of securing firearms against unauthorized use, but they all have various disadvantages associated with them. For example, locked cabinets, trigger locks, cable locks and other locking devices hinder quick access to a firearm to different degrees.

Additionally, the shape of each gun (firearm) is different. For example, the frame of a gun varies substantially from gun to gun. For purposes herein, the frame of a gun is the housing that includes the handle and the trigger guard, wherein all other parts of the gun are either contained within the frame or connected to it. Therefore, firearm locking devices (or security devices) will vary depending on the geometric shape of the gun that the locking device is securing. As such, the cost of manufacturing such firearm locking devices may be increased due to the variety of gun shapes that the locking devices must accommodate.

Accordingly, there is a need for a firearm locking device that is capable of securing a variety of different guns in a variety of different shapes. Also there is a need for a firearm locking device that can accommodate to a variety of gun shapes without significantly modifying the design of the locking device and, therefore, without significantly increasing the cost of the locking device.

There is also a need to provide efficient access to the firearm from a locking device by an authorized user of the firearm. Further a firearm locking device is needed which can authenticate an authorized user and release the firearm substantially simultaneously.

BRIEF DESCRIPTION

The present invention offers advantages and alternatives over the prior art by providing a locking device for a firearm. The locking device includes a removable insert. The removable insert includes a contoured surface that conforms to a frame surface of a firearm to secure the firearm. The locking device may have a plurality of inserts with a plurality of contoured surfaces for securing a plurality of associated firearms. Different inserts can be manufactured and disposed within the same firearm locking device without having to redesign the entire locking device to accommodate different firearms.

A locking device in accordance with one or more aspects of the present invention includes a housing. A locking mechanism is mounted within the housing. A locking bolt is operatively connected to the locking mechanism such that the locking bolt is moveable from an unlocked position to a locked position. A first insert is sized to be removably received within an insert aperture of the housing. The first insert includes a first locking bolt hole sized to receive the locking bolt. The first insert also includes a first trigger guard cavity sized to receive a first trigger guard of a first firearm, and a first insert contoured surface shaped to conform to a first frame surface of the first firearm. When the first insert is disposed within the insert aperture and the locking bolt is in the locked position, the locking bolt extends through the first locking bolt hole and extends at least partially through the first trigger guard, and the first insert contoured surface engages the first frame surface, to secure the first firearm.

Another locking device in accordance with one or more aspects of the present invention includes a housing and a locking mechanism mounted within the housing. A locking bolt is operatively connected to the locking mechanism such that the locking bolt is moveable from an unlocked position to a locked position. A plurality of inserts are sized to be removably received within an insert aperture of the housing. Each insert of the plurality of inserts includes a locking bolt hole sized to receive the locking bolt. Each insert of the plurality of inserts also includes a trigger guard cavity sized to receive a trigger guard of a firearm associated with each such insert. Each insert of the plurality of inserts also includes an insert contoured surface shaped to conform to a frame surface of the associated firearm. When an insert of the plurality of inserts is disposed within the insert aperture and the locking bolt is in the locked position, the locking bolt extends through the locking bolt hole and extends at least partially through the trigger guard of the associated firearm, and the insert contoured surface engages the frame surface of the associated firearm, to secure the associated firearm.

DRAWINGS

The invention will be more fully understood from the following detailed description taken in conjunction with the accompanying drawings, in which.

DETAILED DESCRIPTION

Certain exemplary embodiments will now be described to provide an overall understanding of the principles of the structure, function, manufacture, and use of the methods, systems, and devices disclosed herein. One or more examples of these embodiments are illustrated in the accompanying drawings. Those skilled in the art will understand that the methods, systems, and devices specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention.

The terms "substantially", "approximately", "about", "relatively" or other such similar terms that may be used throughout this disclosure, including the claims, are used to describe and account for small fluctuations, such as due to variations in processing. For example, they can refer to less than or equal to ±10%, such as less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

Figure 1:
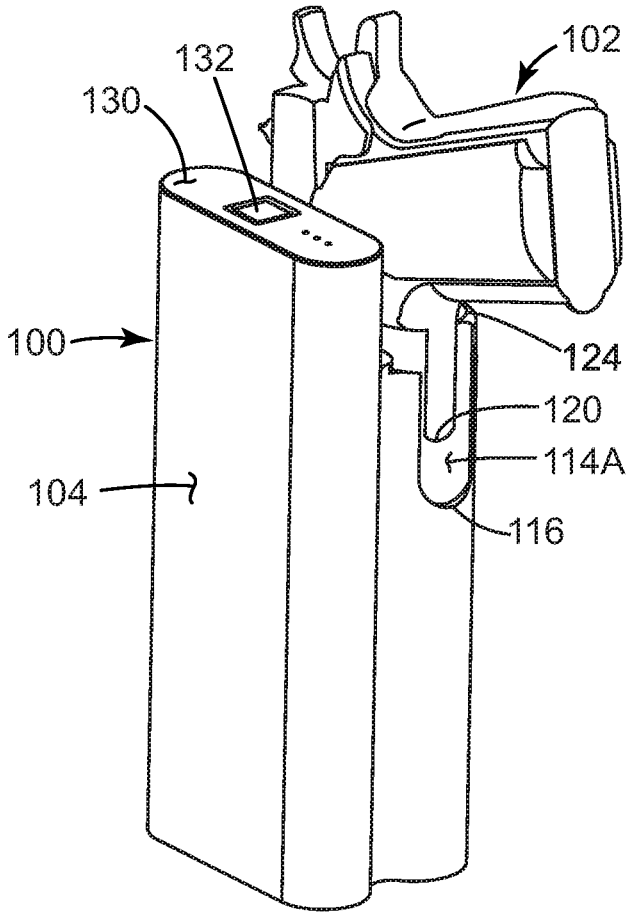
FIG. 1 is a perspective view of an exemplary embodiment of a firearm locking device securing a firearm in accordance with the present invention.

Referring to FIG. 1, a simplified perspective view of an exemplary embodiment of a firearm locking device 100 in which a firearm 102 is secured in accordance with the present invention is presented. For purposes herein, the term "secured" means preventing access to the firearm in such a way that it cannot be fired.

In the embodiment of FIG. 1, the firearm locking device 100 includes a housing 104. Mounted within the housing 104 is a locking mechanism 106 (seen in detail in FIGS. 7-10). A locking bolt 108 (best seen in 9-10) is operatively connected to the locking mechanism 106 such that the locking bolt 108 is moveable from an unlocked position 110 (best seen in FIG. 9) to a locked position 112 (best seen in FIG. 10).

The locking bolt 108, in this embodiment, has an oblong cross-sectional shape. However, the locking bolt can have any number of cross-sectional shapes. For example, the cross-sectional shape of the locking bolt 108 may be rectangular, square, round or other shapes.

Figure 5A:
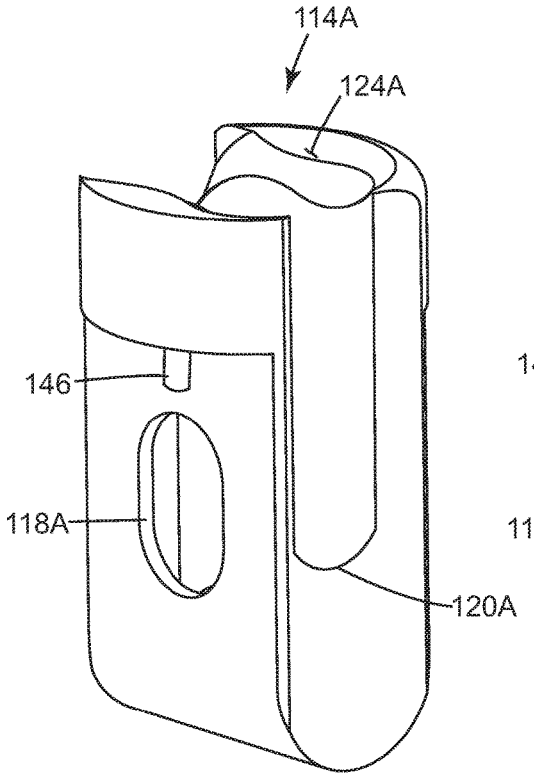
FIG. 5A is a perspective view of an exemplary embodiment of a first removable insert of the firearm locking device of FIG. 1 in accordance with the present invention.

An insert 114 is sized to be removably received within an insert aperture 116 of the housing 104. In this specific embodiment, the insert 114 is a first insert 114A, which is best seen in FIG. 5A.

The first insert 114A includes a first locking bolt hole 118. In this specific embodiment, the locking bolt hole 118 is a first locking bolt hole 118A, which is best seen in FIG. 5A. The first locking bolt hole 118 is sized to receive the locking bolt 108.

In this embodiment, the trigger guard aperture 116 is a U-shaped slot. However the aperture may have any number of shapes. For example, the trigger guard aperture 116 may be a hole that has a square cross-sectional shape, a circular cross-sectional shape and more.

The first insert 114A also includes a trigger guard cavity 120. In this specific embodiment, the trigger guard cavity 120 is a first trigger guard cavity 120A, which is best seen in FIG. 5A. The first trigger guard cavity 120 is sized to receive a first trigger guard 122 (best seen in FIGS. 3 and 4) of the first firearm 102.

The first insert 114A also includes an insert contoured surface 124. In this specific embodiment, the insert contoured surface 124 is a first insert contoured surface 124A, which is best seen in FIG. 5A.

Figure 3:
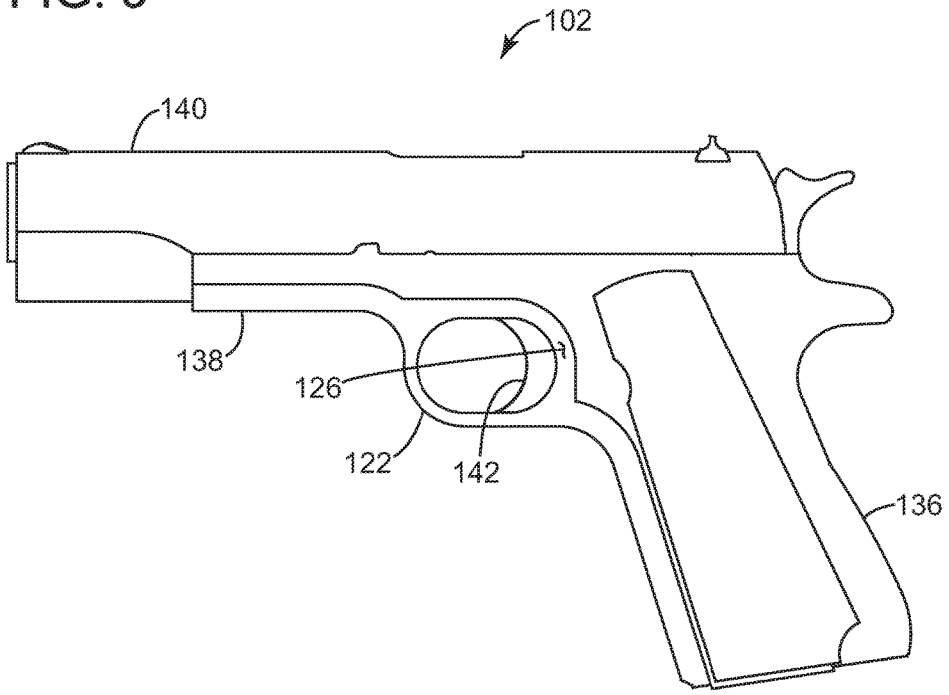
FIG. 3 is a perspective view of an exemplary embodiment of the firearm that is disengaged from the firearm locking device of FIG. 1 in accordance with the present invention.
Figure 4:
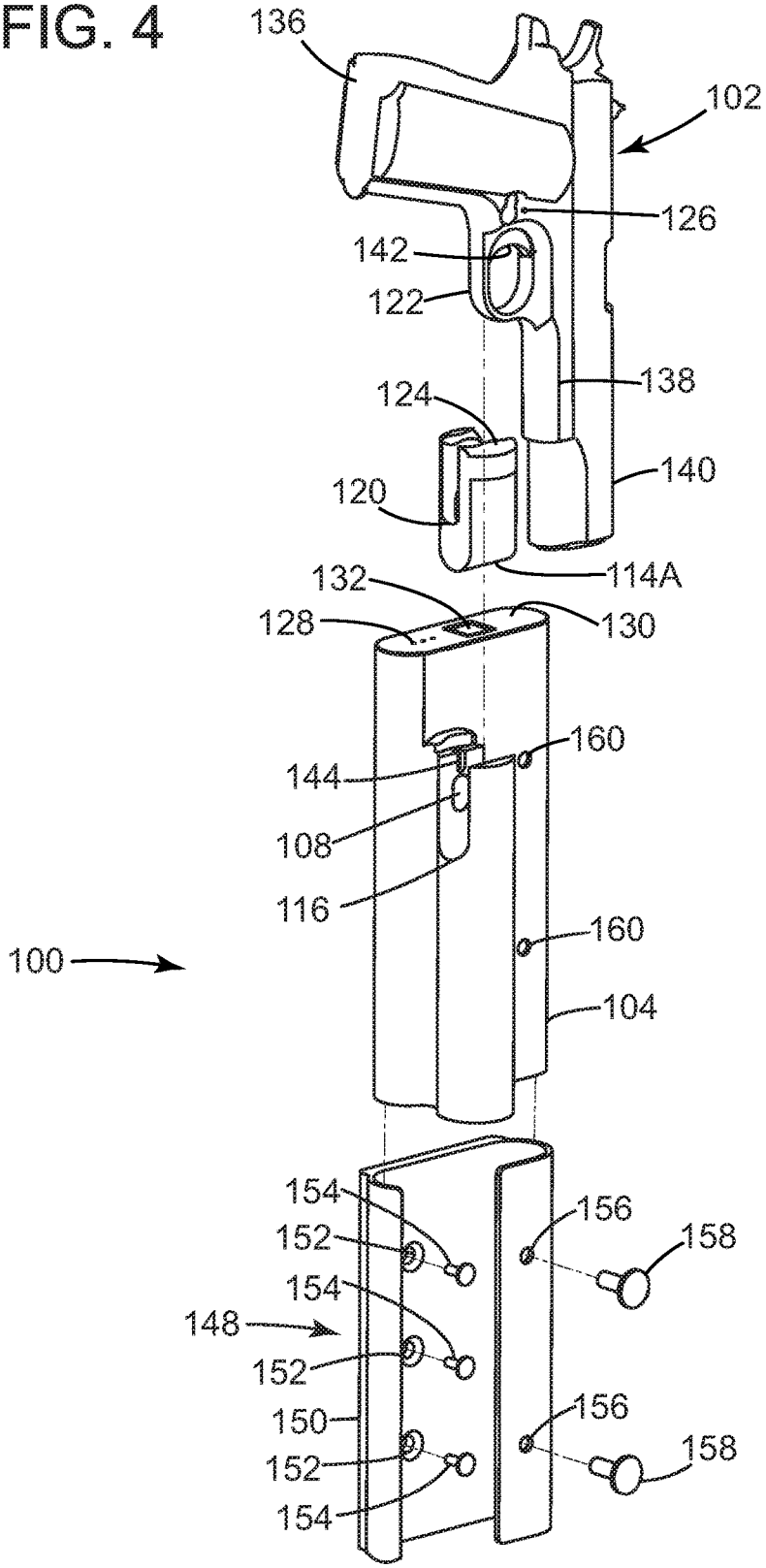
FIG. 4 is an exploded view of an exemplary embodiment of the firearm locking device of FIG. 1 in accordance with the present invention.

The first insert contoured surface 124 is shaped to conform to a first frame surface 126 (best seen in FIGS. 3 and 4 of the first firearm 102). As will be discussed in greater detail herein, and more specifically with reference to FIGS. 5A and 5B, the geometric shape of both the trigger guard cavity 120 and the insert contoured surface 124 may vary from one first insert 114A to the another second insert 114B depending on the shape of the firearm 102 that is being secured.

When the first insert 114A is disposed within the insert aperture 116, and the locking bolt 108 is in the locked position 112, the locking bolt extends through the first locking bolt hole 118 and extends at least partially through the first trigger guard 122. Additionally, with the locking bolt 108 in the locked position 112, the first insert contoured surface 124 engages the first frame surface 126, to secure the first firearm 102.

In this embodiment, the insert contoured surface 124 substantially matches the first frame surface 126 where the insert 114A abuts against the first frame surface 126. As such, there are no openings between the insert contoured surface 124 and the first frame surface 126 that a non-authorized user may utilize to reach the trigger of the firearm, with or without a tool. Accordingly, the firearm 102 cannot be fired and is, therefore, secured by the firearm locking device 100.

Disposed on a top surface 130 of the housing 104 is a fingerprint sensor 132. The fingerprint sensor 132 is electronically connected to the locking mechanism 106 and is used to sense an authorized user's thumbprint (best seen in FIG. 2) before enabling the locking mechanism 106 to move the locking bolt 108 from the locked position 112 to the unlocked position 110.

Figure 2:
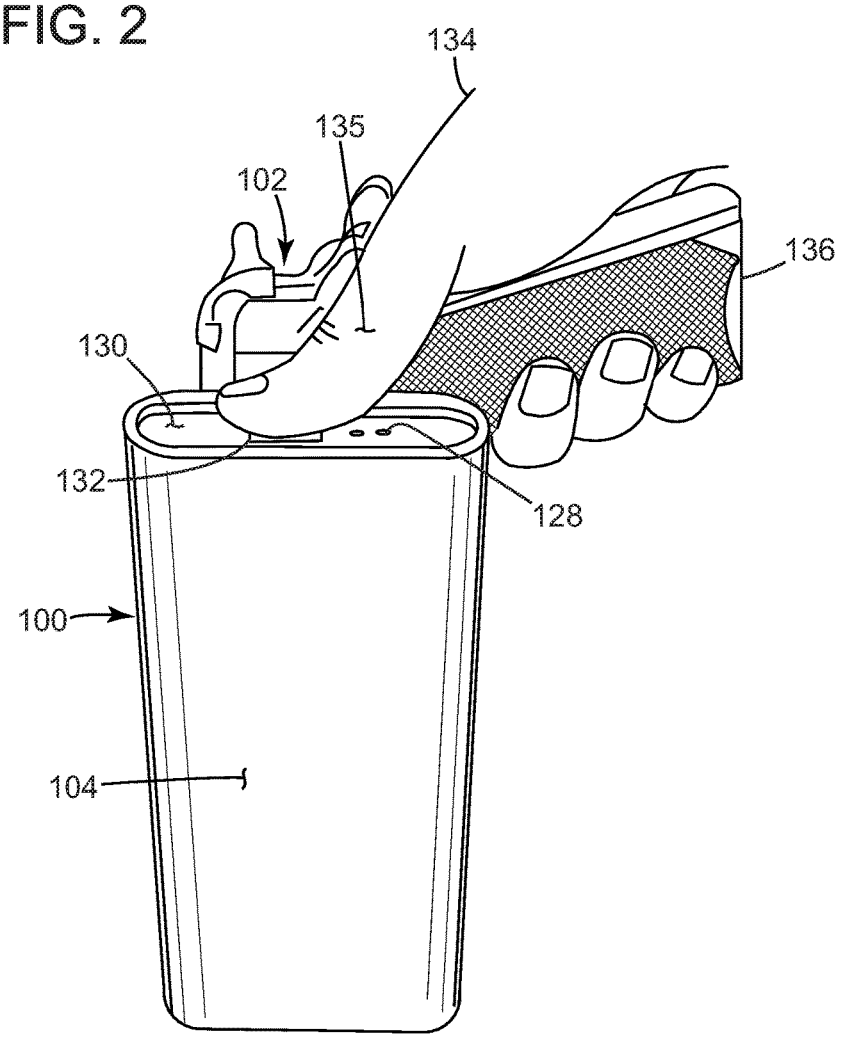
FIG. 2 is a perspective view of an exemplary embodiment of the firearm locking device of FIG. 1, wherein an authorized user's thumb is aligned with a fingerprint sensor on a housing of the firearm locking device as the user grips a handle of the firearm in accordance with the present invention.

Referring to FIG. 2, a perspective view of an exemplary embodiment of the firearm locking device 100 of FIG. 1 is presented, wherein an authorized user 134 grips a handle 136 of the firearm 102. In this position, the authorized user's thumb 135 is aligned with the fingerprint sensor 132 on the top surface 130 of the housing 104 of the firearm locking device 100.

The locking device mechanism 106 of the firearm locking device 100 requires authentication to be provided from an authorized user 134 before moving the locking bolt 108 from the locked position 112 to the unlocked position 110. In this embodiment, the authentication is an authentication signal transmitted from the fingerprint sensor 132 that an authorized user's thumbprint has been verified. Once an authorized user's thumbprint has been authenticated, the locking mechanism 106 may move the locking bolt 108 to the unlocked position 110 substantially simultaneously with the authentication. Therefore the firearm is allowed to be rapidly and efficiently disengaged from the firearm locking device 100.

Though this embodiment illustrates a thumbprint as the required authentication, other forms of biometric data may be provided from an authorized user before moving the locking bolt 108 from the locked position 112 to the unlocked position 110. For example, fingerprints of other digits on the user's hand or other forms of biometric data may be required depending on the design of the firearm locking device 100.

This embodiment also illustrates the fingerprint sensor 132 mounted on the top surface 130 of the housing 104 of the firearm locking device 100, wherein the authentication signal is transmitted via hard wiring to the locking mechanism 106. However, the fingerprint sensor 132 may also be mounted remotely to the firearm locking device 100, wherein the authentication signal may be transmitted wirelessly. For example, the authentication signal may be transmitted by a radio frequency authentication signal, a Bluetooth authentication signal or similar.

Though this embodiment illustrates various forms of biometric data being used to provide authentication for enabling the locking mechanism 106, other forms of authentication may be utilized as well. For example, authentication of an authorized user may include an electronic key or a mechanical key to enable the locking mechanism 106 to move the locking bolt 108 from the locked position 112 to the unlocked position 110.

In this specific embodiment, a set of indicator lights 128 illuminate a certain color (for example, green) when an authorized user's thumbprint has been sensed by the fingerprint sensor 132. If an unauthorized user's thumbprint is sensed by the fingerprint sensor 132, then the indicator lights 128 may be illuminated a different color (for example, red).

Referring to FIG. 3, a perspective view of an exemplary embodiment of the firearm 102 that is disengaged from the firearm locking device 100 is presented. The firearm 102 includes a frame 138, which is the housing that includes the handle 136 and the trigger guard 122 of the firearm 102. All other parts of the gun are either contained within the frame 138 or connected to it.

The barrel 140 of the firearm 102, i.e., the metal tube that cartridges travel through, is rigidly mounted on the top portion of the frame. The action mechanism (not shown), sometime known as the trigger group, is housed within the frame and contains the parts that fire the cartridges. The action mechanism also includes the trigger 142 of the firearm 102.

Each firearm frame 138 has a contoured frame surface 126 in the area proximate to the trigger. The frame surface 126 and trigger guard 122 vary in geometric shape depending on the design of each type of firearm 102. As such, in order to prevent access to the trigger 142 by an unauthorized user for more than one type of firearm, the geometric shape of the portion of the firearm locking device 100 that surrounds the trigger guard 122 and abuts the frame surface 126 must also change.

As will be discussed in greater detail herein, that portion of the locking device 100 which both surrounds the trigger guard 122 and abuts the frame surface 126 is the removable modular insert 114. Advantageously therefore, only the design of the insert 114 needs to change in order to secure more than one type of gun.

Referring to FIG. 4, an exploded view of an exemplary embodiment of the firearm locking device of FIG. 1 is presented. In this embodiment, the first insert 114A is designed for a slip fit into the insert aperture 116 of the housing 104.

The insert aperture 116 includes a keyway 144 that is sized to receive a key 146 (best seen in FIGS. 5A and 5B) that is included in the first insert 114A. When the first insert 114A is disposed within the insert aperture 116, the key 146 mates with the keyway 144 such that the first insert 114A is retained within the insert aperture 116 and does not fall out of the insert aperture 116 when the firearm 102 is removed from the locking device 100. Additionally, the key 146 and keyway 144 properly orient the first insert 114A such that the contoured surface 124 of the insert 114A mates with the frame surface 126 of the firearm 102, when the firearm 102 is inserted into the firearm locking device 100.

Though this embodiment illustrates the key 146 being disposed on the insert 114A and the keyway 148 being disposed in the insert aperture 116, the opposite disposition of key 146 and keyway 148 may also be utilized. That is, the key 146 may be disposed in the insert aperture 116 and the keyway 144 may be disposed on the insert 114.

The locking device 100, in this embodiment, also includes a mounting bracket 148. The bracket 148 is sized to receive the housing 104 of the firearm locking device 100. More specifically, in this embodiment, the bracket includes a bracket body 150 that wraps at least partially around the housing 104 of the firearm locking device 100.

The bracket 148 further includes bracket mounting holes 152 disposed through a back portion of the bracket body 150. The bracket mounting holes 152 are sized to receive bracket mounting fasteners 154 to rigidly mount the bracket 148 against a fixed object (not shown), such as a wall or other fixed object.

The bracket 148 further includes housing mounting holes 156 disposed through a front portion of the bracket body 150. The housing mounting holes 156 are sized to receive housing mounting fasteners 158. The housing mounting fasteners 158 are sized to extend through the housing mounting holes 156 and into threaded holes 160 disposed in the housing 104 to rigidly mount the housing 104 to the bracket 148.

When the bracket 148 is mounted to the fixed object (not shown), the housing 104 is mounted to the bracket 148 and the first firearm 102 is secured by the locking device 100, then the housing 104 blocks access to the bracket mounting fasteners 154 and the barrel 140 of the first firearm 102 blocks access to the housing mounting fasteners 158. More specifically, after the bracket 148 has been mounted to a fixed object such as a wall, the housing 104 of the firearm locking device 100 can then be slip-fit into the bracket 148 to cover over the bracket mounting fasteners 154. The housing 104 can then be rigidly mounted to the bracket 148 with the housing mounting fasteners 158. Thereafter, when the firearm 102 is secured and locked into the firearm locking device 100, the barrel 140 of the firearm 102 covers over the housing mounting fasteners 158. Accordingly, both the bracket mounting fasteners 154 and housing mounting fasteners 158 are blocked from access until an authorized user 134 disengages the firearm 102 from the firearm locking device 100.

Figure 5B:
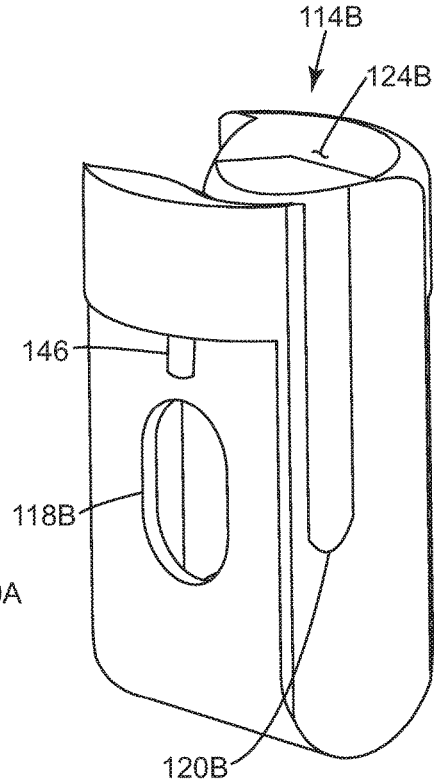
FIG. 5B is a perspective view of an exemplary embodiment of a second removable insert of the firearm locking device of FIG. 1 in accordance with the present invention.

Referring to FIGS. 5A and 5B, a perspective view of an exemplary embodiment of the first removable insert 114A (FIG. 5A) and a second removable insert 114B (FIG. 5B) of the firearm locking device of FIG. 1 is presented. As discussed earlier, the first insert 114A is sized to be removably received within the insert aperture 116 of the housing 104. The first insert 114A includes the first locking bolt hole 118A, the first trigger guard cavity 120A and the first insert contoured surface 124A. Additionally the insert 114A includes the key 146.

The second insert 114B is also sized to be removably received within the insert aperture 116 of the housing 104. The second insert 114B includes the key 146 sized to engage with the keyway 144 and a second locking bolt hole 118B sized to receive the locking bolt 108.

Additionally, the second insert 114B includes a second trigger guard cavity 120B that is sized to receive a second trigger guard (not shown) of a second firearm (not shown). Further the second insert 114B includes a second insert contoured surface that is shaped to conform to a second frame surface (not shown) of the second firearm. Since the trigger guards 122 of the first and second firearms 102 may not have the same geometric shape, than the second trigger guard cavity 120B may be geometrically different from the first trigger guard cavity 120A.

Also, frame surfaces 126 of the first and second firearms 102 may not have the same geometric shape. Since the second insert contoured surface 124B is shaped to substantially match the second frame surface of the second firearm, than the second insert contoured surface 124B may be geometrically different from the first insert contoured surface 124A.

Advantageously, only the trigger guard cavity 120 and the insert contoured surface 124 of the insert 114 have to be modified in order to secure different firearms 102 with varying geometric shapes. Therefore only the insert 114 of the firearm locking device 100 would have to be replaced to accommodate a plurality of different firearms.

The modular aspects of the insert 114 enables the firearm locking device 100 to be easily upgraded to work with new firearms and significantly improves the compatibility of the firearm locking device 100 with different firearms. Additionally, the modular aspect of the firearm locking device 100 serves to reduce retail costs and to decrease the manufacturing warehousing costs by limiting the number of variations required for inventory.

The embodiments of FIGS. 5A and 5B show two inserts 114A, 114B. However the two inserts 114A, 114B may be included in a plurality of inserts 114 for securing a plurality of firearms 102. The plurality of inserts 114 may range in number from 2 to 10 to 25 and more.

Figure 6:
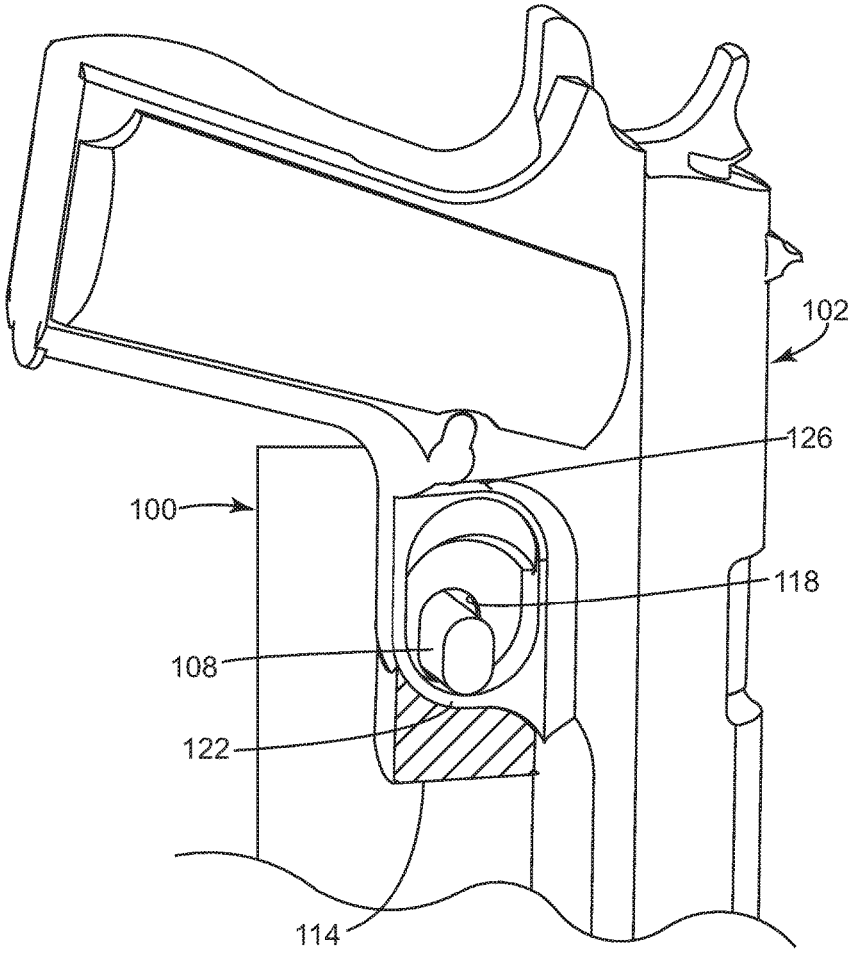
FIG. 6 is a partial cross-sectional view of an exemplary embodiment of the firearm locking device of FIG. 1 showing a locking bolt of the firearm locking device in its locked position in accordance with the present invention.

Referring to FIG. 6, a partial cross-sectional view of an exemplary embodiment of the firearm locking device 100 of FIG. 1 showing the locking bolt 108 of the firearm locking device 100 in its locked position 112 is presented. When the insert 114 (whether it be 114A or 114B) is disposed within the insert aperture 116 of the firearm locking device 100 and the locking bolt 108 is in the locking position 112, then the locking bolt 108 extends through the locking bolt hole 118 and at least partially through the trigger guard 122. Additionally, the insert contoured surface 124 engages the frame surface 126 to secure the firearm 102.

Figure 7:
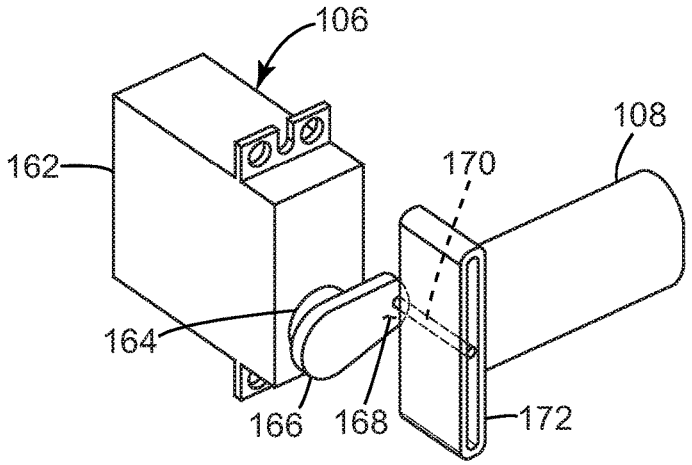
FIG. 7 is a perspective view of an exemplary embodiment of a locking mechanism of the firearm locking device of FIG. 1 in accordance with the present invention.
Figure 8:
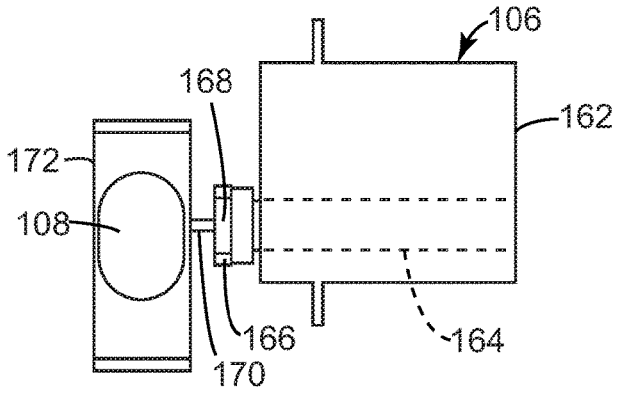
FIG. 8 is a side view of an exemplary embodiment of the locking mechanism of FIG. 7 in accordance with the present invention.

Referring to FIGS. 7 and 8, a perspective view (FIG. 7) and a side view (FIG. 8) of an exemplary embodiment of the locking mechanism 106 of the firearm locking device 100 of FIG. 1 is presented. The locking mechanism 106 includes a servo motor 162 rigidly mounted within the housing 104. The servo motor 162 includes a motor shaft 164. A cam 166 is rigidly mounted to the motor shaft 164. The cam 166 includes an eccentric portion 168. A pin 170 is rigidly mounted to the eccentric portion 168 of the cam 166. A channel 172 is slidably mounted to the pin 170. The channel 170 is operably connected to the locking bolt 108 such that when the servo motor 162 rotates the cam 166, the locking bolt 108 moves substantially linearly from the unlocked position 110 to the locked position 112.

Though the locking mechanism 106 is illustrated as including a servo motor 162, other types of motors may also be used. For example a stepper motor or other similar motor.

Additionally, the locking mechanism 106 does not have to include a motor, but can be a mechanical system that is hand operated. The mechanical system may be enabled by a key, wherein the key is mechanical or electronic.

Moreover, the locking mechanism 106 does not have to include a cam 166. Rather any mechanical structure, which provides linear motion to the locking bolt 108 may be used. For example, a linear gear system or other similar gear system.

Figure 9:
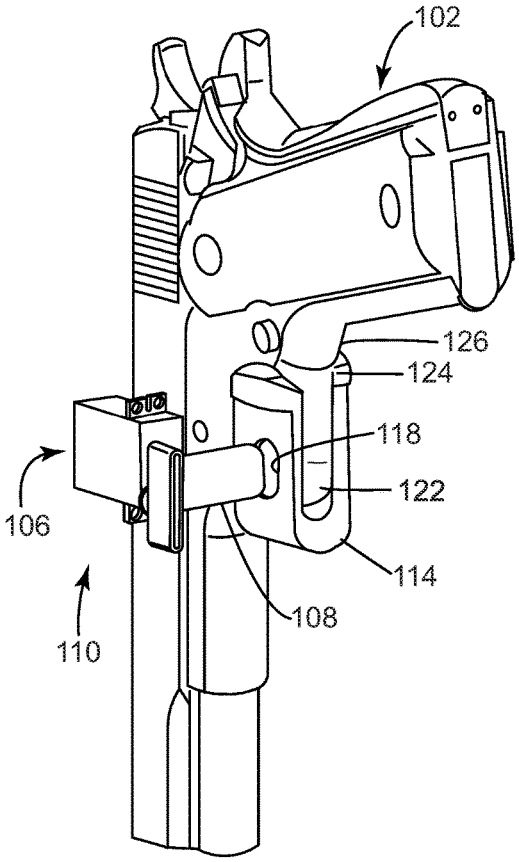
FIG. 9 is a perspective view of an exemplary embodiment of the locking mechanism of FIG. 7 with the locking bolt in the unlocked position in accordance with the present invention.
Figure 10:
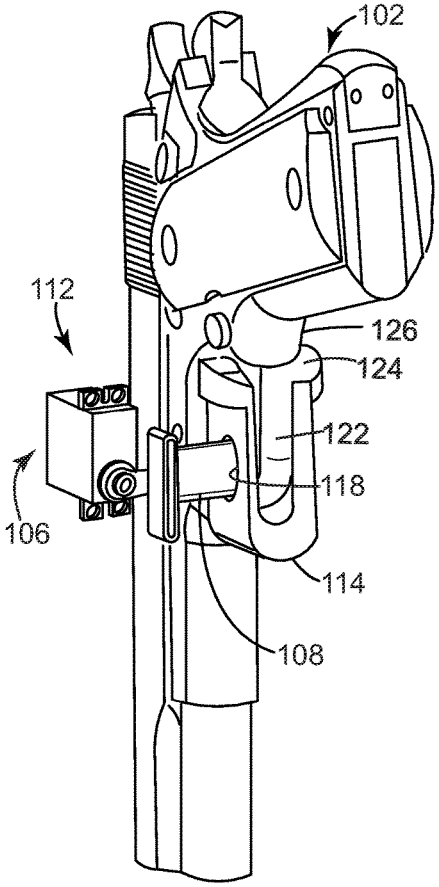
FIG. 10 is a perspective view of an exemplary embodiment of the locking mechanism of FIG. 7 with the locking bolt in the locked position in accordance with the present invention.

Referring to FIGS. 9 and 10, a perspective view of an exemplary embodiment of the locking mechanism 106 of FIG. 7 with the locking bolt 108 in the unlocked position 110 (FIG. 9) and in the locked position 112 (FIG. 10) is presented. Referring more specifically to FIG. 9, when the locking mechanism 106 has the locking bolt 108 in its unlocked position 110, the locking bolt 108 does not extend through the locking bolt hole 118 of the insert 114 and the firearm 102 may be disengaged from the locking device 100.

Referring more specifically to FIG. 10, when the locking bolt 108 is in the locked position 112, the locking bolt 108 extends through the locking bolt hole 118 of the insert 114 and at least partially through the trigger guard 122. Additionally, the insert contoured surface 124 engages the frame surface 126, to secure the firearm 102.

Although the invention has been described by reference to specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. A locking device for a firearm, the locking device comprising:
- a housing;
- a locking mechanism mounted within the housing;
- a locking bolt operatively connected to the locking mechanism such that the locking bolt is moveable from an unlocked position to a locked position; and
- a first insert sized to be removably received within an insert aperture of the housing, the first insert including:
  - a first locking bolt hole sized to receive the locking bolt,
  - a first trigger guard cavity sized to receive a first trigger guard of a first firearm, and
  - a first insert contoured surface shaped to conform to a first frame surface of the first firearm;

wherein, when the first insert is disposed within the insert aperture and the locking bolt is in the locked position, the locking bolt extends through the first locking bolt hole and extends at least partially through the first trigger guard, and the first insert contoured surface engages the first frame surface, to secure the first firearm.

2. The locking device of claim 1 comprising:
- a second insert sized to be removably received within the insert aperture of the housing, the second insert including:
  - a second locking bolt hole sized to receive the locking bolt,
  - a second trigger guard cavity sized to receive a second trigger guard of a second firearm, and a second insert contoured surface shaped to conform to a second frame surface of the second firearm;

wherein one of the second trigger guard cavity is different from the first trigger guard cavity and the second insert contoured surface is different from the first insert contoured surface.

3. The locking device of claim 2 wherein, when the second insert is disposed within the insert aperture and the locking bolt is in the locked position, the locking bolt extends through the second locking bolt hole and extends at least partially through the second trigger guard, and the second insert contoured surface engages the second frame surface, to secure the second firearm.

4. The locking device of claim 2 wherein the first and second inserts comprise a plurality of inserts for securing a plurality of firearms.

5. The locking device of claim 1 comprising wherein, when the locking bolt is in the unlocked position, the locking bolt does not extend through the first locking bolt hole of the first insert and the first firearm may be disengaged from the locking device.

6. The locking device of claim 2 comprising:

the first insert contoured surface shaped to substantially match the first frame surface of the first firearm; and the second insert contoured surface shaped to substantially match the second frame surface of the second firearm.

7. The locking device of claim 1 comprising:

the first insert including one of a key and a keyway; and the insert aperture including the other of a key and a keyway;

wherein, when the first insert is disposed within the insert aperture, the key mates with the keyway such that the first insert is retained within the insert aperture and does not fall out of the insert aperture when the firearm is removed from the locking device.

8. The locking device of claim 1 wherein, the locking mechanism requires biometric data to be provided from an authorized user before moving the locking bolt from the locked position to the unlocked position.

9. The locking device of claim 8 comprising a fingerprint sensor disposed on a top surface of the housing such that an authorized user's thumb aligns with the fingerprint sensor when the authorized user grips a handle of the first firearm.

10. The locking device of claim 1 wherein the locking mechanism comprises:

a servo motor rigidly mounted within the housing, the servo motor including a motor shaft;

a cam rigidly mounted to the motor shaft, the cam including an eccentric portion;

a pin rigidly mounted to the eccentric portion of the cam;

a channel slidably mounted to the pin; and the channel operably connected to the locking bolt such that when the servo motor rotates the cam, the locking bolt moves substantially linearly from the unlocked position to the locked position.

11. The locking device of claim 1 comprising:

a bracket sized to receive the housing, the bracket including:

bracket mounting holes sized to receive bracket mounting fasteners to rigidly mount the bracket against a fixed object, and housing mounting holes sized to receive housing mounting fasteners to rigidly mount the housing to the bracket;

wherein when the bracket is mounted to the fixed object, the housing is mounted to the bracket and the first firearm is secured by the locking device, then the housing blocks access to the bracket mounting fasteners and a barrel of the first firearm blocks access to the housing mounting fasteners.

12. The locking device of claim 1 wherein, the locking mechanism requires authentication to be provided from an authorized user before moving the locking bolt from the locked position to the unlocked position.

13. The locking device of claim 12 wherein the authentication comprises one of a radio frequency authentication signal, a Bluetooth authentication signal, an electronic key and a mechanical key.

14. A locking device for a firearm, the locking device comprising: a housing;

a locking mechanism mounted within the housing;

a locking bolt operatively connected to the locking mechanism such that the locking bolt is moveable from an unlocked position to a locked position; and a plurality of inserts sized to be removably received within an insert aperture of the housing, each insert of the plurality of inserts including:

a locking bolt hole sized to receive the locking bolt, a trigger guard cavity sized to receive a trigger guard of a firearm associated with each such insert, and an insert contoured surface shaped to conform to a frame surface of the associated firearm;

wherein, when an insert of the plurality of inserts is disposed within the insert aperture and the locking bolt is in the locked position, the locking bolt extends through the locking bolt hole and extends at least partially through the trigger guard of the associated firearm, and the insert contoured surface engages the frame surface of the associated firearm, to secure the associated firearm.

15. The locking device of claim 14 wherein each trigger guard cavity of each insert of the plurality of inserts is different from other trigger guard cavities of other inserts of the plurality of inserts.

16. The locking device of claim 14 wherein each insert contoured surface of each insert of the plurality of inserts is different from other insert contoured surfaces of each insert of the plurality of inserts.

17. The locking device of claim 14 wherein each insert contoured surface of each insert of the plurality of inserts is shaped to substantially match the frame surface of their associated firearm.

18. The locking device of claim 14 wherein, the locking mechanism requires biometric data to be provided from an authorized user before moving the locking bolt from the locked position to the unlocked position.

19. The locking device of claim 18 comprising a fingerprint sensor disposed on a top surface of the housing such that an authorized user's thumb aligns with the fingerprint sensor when the authorized user grips a handle of a firearm.

* * * * *